US006035446A

United States Patent [19]

Johnson

[11] Patent Number: 6,035,446

[45] Date of Patent: Mar. 14, 2000

[54] HEADWEAR WITH WOOD VISOR

[76] Inventor: Todd B. Johnson, P.O. Box 242, Woodville, Wis. 54028

[21] Appl. No.: 09/111,647

[22] Filed: Jul. 8, 1998

Related U.S. Application Data

[60] Provisional application No. 60/052,177, Jul. 10, 1997.

[51] Int. Cl.[7] ..... A42B 1/06

[52] U.S. Cl. ..... 2/200.1; 2/12; 2/195.1; D2/872

[58] Field of Search ..... 2/10, 12, 195.1, 2/195.6, 200.1; D2/872, 873, 882, 893

*Primary Examiner*—Diana Oleksa

*Attorney, Agent, or Firm*—Faegre & Benson LLP

[57] ABSTRACT

A visor for attachment to a support element is provided that comprises either a rigid wood layer, or an exterior surface that has a wood grain appearance. Also provided is a hat in combination with the visor of the present invention. The visor, as well as the hat and visor combination, provide the advantages of being attractive, weather resistant, durable, rigid and pre-shaped.

40 Claims, 6 Drawing Sheets

10
13
14
19
18
22
25

HEADWEAR WITH WOOD VISOR

REFERENCE TO RELATED APPLICATION

This application claims the benefit of U.S. Provisional Application Ser. No. 60/052,177 filed on Jul. 10, 1997.

BACKGROUND OF THE INVENTION

In many fields of outdoor activity, people are exposed to adverse climatic conditions for extended periods of time. For example, a tennis player or jogger may be continuously exposed to strong sunlight for many hours. That same person may also be exposed to winds or rain for similar extended periods of time.

One way of preventing the adverse effects of climatic conditions is to wear a hat. In particular, baseball caps are especially useful for this purpose. However, in addition to providing protection from the sun and other elements, baseball hats have also become a popular fashion accessory.

Baseball hats are generally made of leather, fabric or woven material having a hemispherical crown. The crown may also be cylindrical with a flat top. Inside the crown at the lower periphery, there is typically a rim or band of reinforced material called a sizing strip that is used to secure the cap to the head. A visor is attached to the forward lower periphery portion of the crown which serves to shield the face of the wearer from the sun, wind, rain, etc.

In spite of their popularity, baseball hats suffer from design flaws. For example, because the visor usually employs a layer of cardboard, i.e., an "insert board", to provide the requisite stiffness, baseball hats are susceptible to water-damage. Specifically, because of the water-degradable nature of the visor, water contact causes the visor to buckle, degrade, or otherwise become unsightly. Furthermore, baseball hats are typically sold with an unformed, or flat, visor, thus requiring the wearer to initially shape and continually re-shape the visor so as to adequately shade the face of the wearer. Finally, baseball hats have a limited lifespan due to the poor durability of the insert board material, i.e., the visor is susceptible to rips or tears.

Attempts at solving these art-recognized disadvantages have proven to be sub-optimal. For example, U.S. Pat. No. 4,249,269 discloses a cap visor comprising upper and lower layers of waterproof plastic with a typical cardboard insert board in between. In this manner, this visor is intended to be relatively weather resistant. However, this visor still lacks long term durability, as the inner layer is still insert board, and lacks aesthetic appeal.

SUMMARY OF THE INVENTION

The present invention relates to a visor, as well as a hat comprising the visor that can be worn and which overcomes the limitations and disadvantages of existing visors. Specifically, the present invention provides a visor that is rigid, pre-shaped, water-resistant, durable and aesthetically pleasing. Specifically, the aforementioned advantages are achieved by providing a visor comprising a rigid wood layer. It is preferred that the rigid wood layer defines a curved, external surface to the visor, and in this manner would provide a visible wood surface to the visor. It is further preferred that the visor comprises a wood laminate, i.e., that the visor comprises a plurality of wood layers. The wood layer, or layers, may comprise oak, walnut, maple, teak, cherry, mahogany, pine or veneers or combinations thereof. Preferably, at least two of the plurality of wood layers are separated by a layer of adhesive. Optionally, at least two of the plurality of wood layers may also be separated by a layer of plywood backing paper.

In order to provide the visor with water-repellent properties, the wood layer may be treated with a waterproofing agent. For example, the wood layer may be treated with a natural wax, such as paraffin, coated with a synthetic waterproofing agent, such as a polyurethane, or both. Preferably, the wood surface is visible through whatever waterproofing agent is applied.

In addition to the aforementioned advantages, the visor of the present invention provides a durable wood surface upon which designs, such as company insignias, may be affixed, thereby providing a unique marketing opportunity. Specifically, the rigid wood layer may have a marking, such as a decal, or a brand (i.e., as results by woodburning) recessed within the wood surface, or may have a marking painted on the surface of the wood layer.

In a preferred embodiment, the visor is present in combination with a support element that is capable of at least partially encircling a wearer's head. For example, the support element may comprise one or more elements that together form an open support that attaches to a wearer's head by applying pressure at a number of points, a band of fabric or other suitable material that completely encircles a wearer's head or a hat. Preferably, the support element is a band or a hat. Most preferably, the support element and the visor are provided in combination so as to make a baseball hat.

The visor and the support element may be attached in accordance with any known method. Preferably, the visor and the support element will be attached in a manner that is not visible on the outside surface of the hat or visor. For example, the visor may be attached to the support element by staples, rivets, adhesive or combinations thereof. More preferably, the visor is attached to the support element with a combination of staples and adhesive.

Another advantage of the present invention is that the visor of the present invention is unique and aesthetically pleasing by virtue of the wood grain surface. In this regard, another embodiment of the invention provides a visor, as well as a visor in combination with a support element, wherein the visor comprises a visible surface with a wood grain appearance. The wood grain appearance does not have to be provided by the inclusion of a wood layer, but may be provided, for example, by an external layer of decorative material exhibiting a wood grain design bonded to the visor.

BRIEF DESCRIPTION OF THE FIGURES

To the accomplishment of the above and related objects, this invention may be embodied in the form illustrated in the accompanying drawings, attentions being called to the fact, however, that the drawings are illustrative only and that changes may be made in the specific construction illustrated and described within the scope of the appended claims.

DETAILED DESCRIPTION OF THE INVENTION

Figure 1:
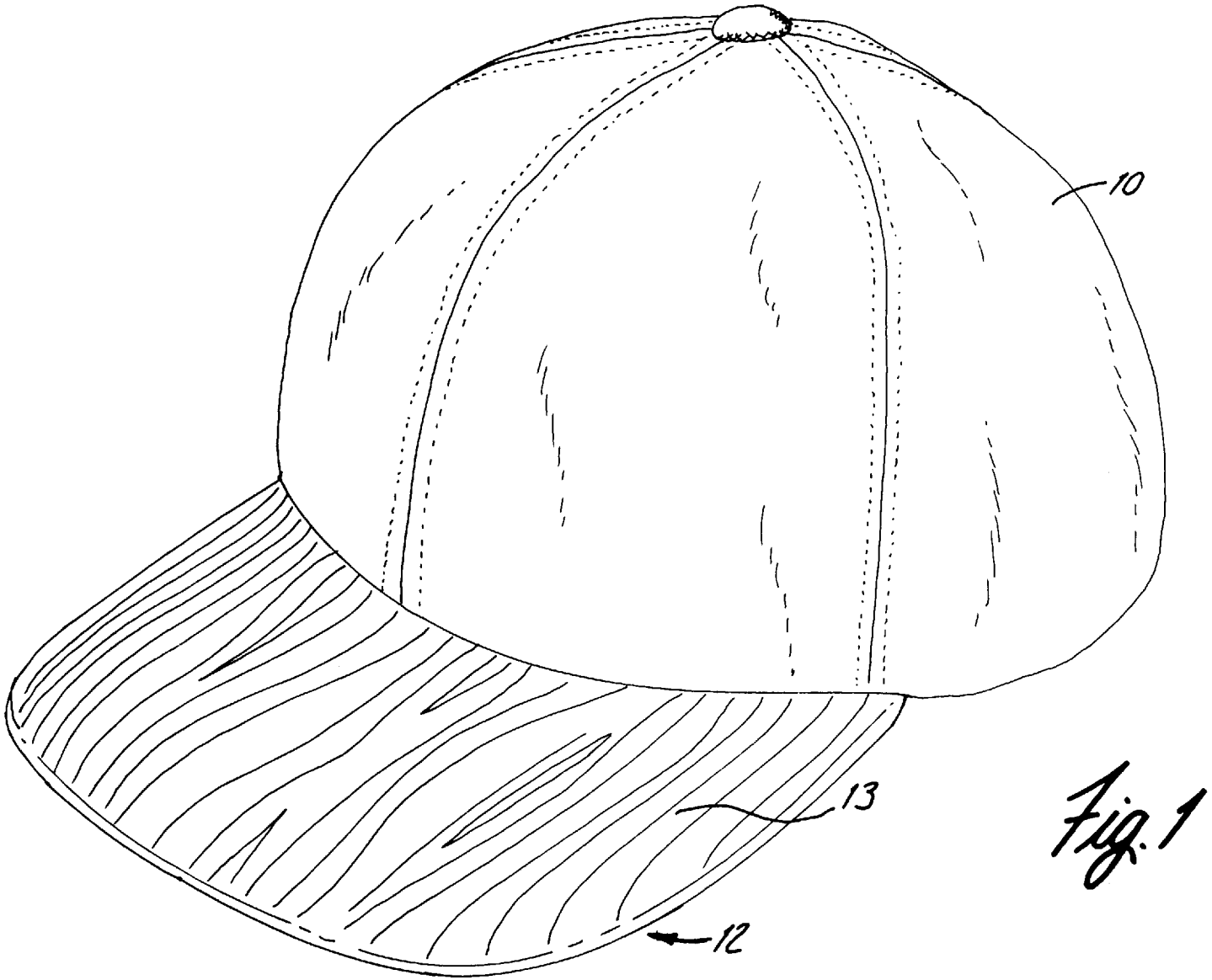
FIG. 1 is a perspective view of the visor and a support element in combination, which together provide a baseball hat.

The visor 12 and support element combination of the present invention are illustrated in perspective view in FIG. 1. In accordance with a preferred embodiment, a visor 12 is shown in combination with a hat 10 to provide a baseball hat. The visor 12 exhibits a wood grain external appearance on at least the top surface 13, and in accordance with the preferred embodiment, comprises wood material, as will be more fully described hereinbelow.

Figure 2:
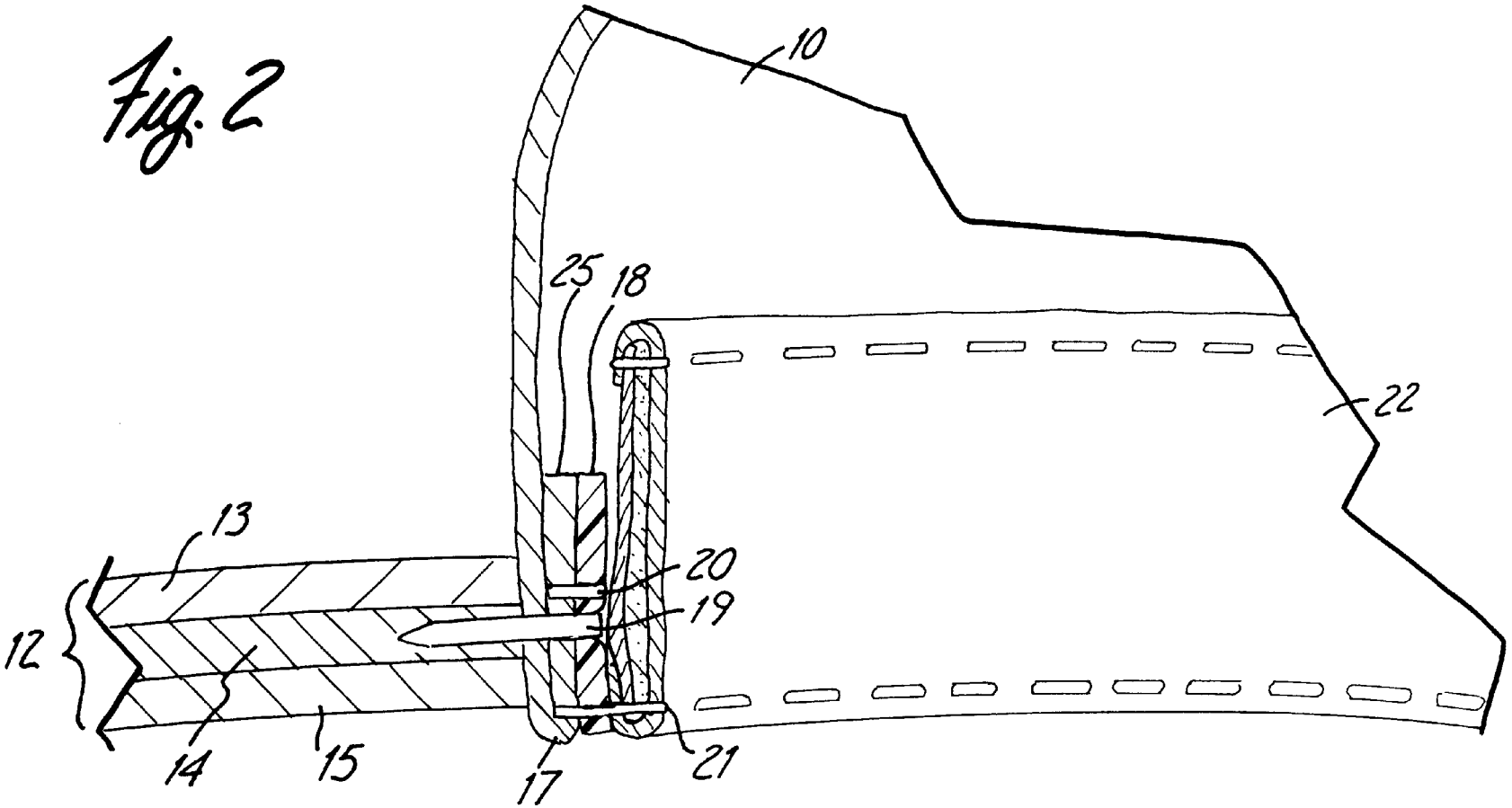
FIG. 2 is a cross-sectional view of the visor and a support element in combination.
Figure 3:
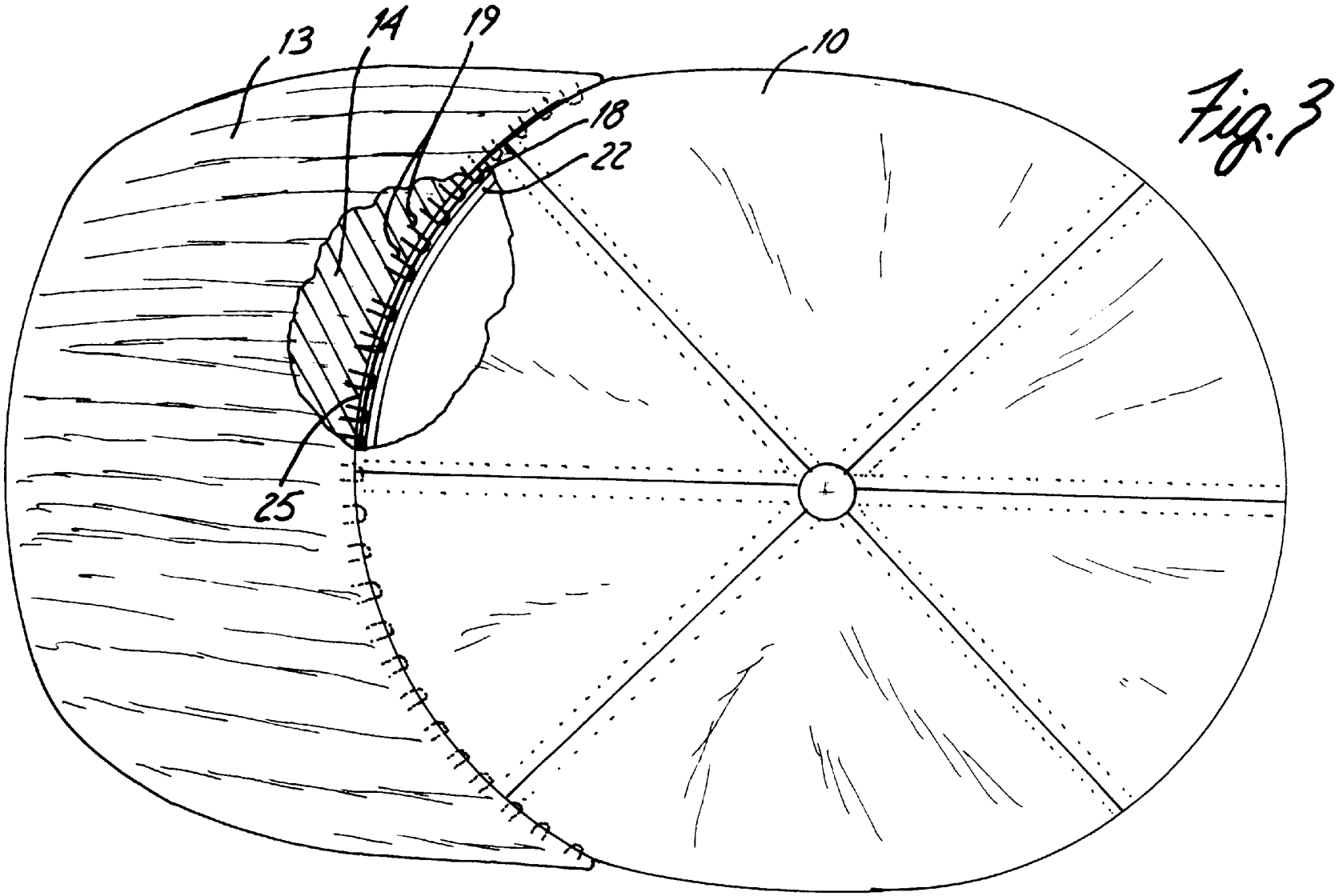
FIG. 3 is an overhead view, partially in cross section of visor and a support element in combination, which together provide a baseball hat.

Referring now to FIG. 2, a preferable manner of attachment between the hat 10 and the visor 12 is detailed. Here, the visor 12 is illustrated as a wood laminate comprising wood layers 13, 14 and 15. Specifically, the material of hat 10 is folded toward the inner surface of the hat to form lower bend 17 and inner flap 25. Sizing strip 18 is attached to the inner flap 25 by conventional sewing techniques, forming stitches 20. Staple 19 is preferably inserted through sizing strip 18, inner flap 25, and the material at the lower edge of hat 10, into the middle wooden layer 14 of visor 12. A conventional fabric strip 22 is then attached to inner flap 25 with conventional sewing techniques, such as by stitches 21. As is illustrated by FIG. 3, a plurality of staples 19 are preferably used to attach visor 12 to hat 10. More specifically, staples 19 are preferably evenly spaced along the interface of the visor 12 and hat 10 in the same manner as described above.

Generally, the present invention provides a visor 12 for attachment to a support element (e.g., hat 10) for at least partially encircling a human head wherein the visor 12 comprises a rigid, wood layer. By the term "rigid" it is meant that the visor 12 is not capable of being bent or folded to a curvature other than the curvature provided at the point of manufacture by the hat wearer. In a preferred embodiment, the wood layer provides a curved, external surface to the visor 12. By "curved", it is meant that the visor 12 is preshaped in a curved shape so as to shade the wearers face from the sun, rain, wind, etc. The specific angle of curvature employed will depend on the size of the wearers head, i.e., a larger angle of curvature is more suitable, for example, for an adult, while a smaller angle of curvature is more suitable for a child.

Figure 4:
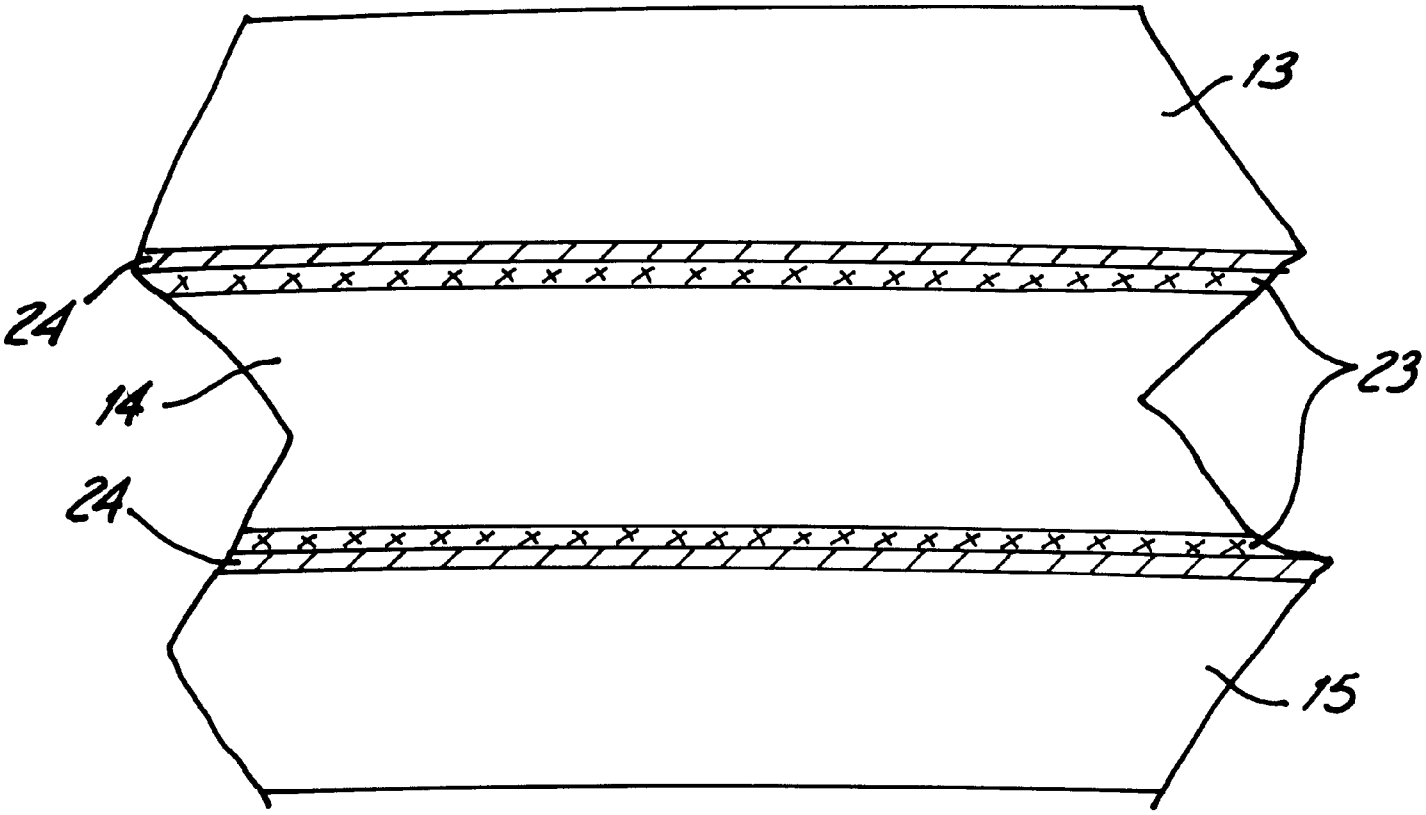
FIG. 4 is a cross-sectional view of the visor of the present invention.

The wood layer may comprise one wood layer or the wood layer may be a wood laminate, i.e., comprising a wood layer laminated with other material layers or a plurality of wood layers. If the wood layer is to comprise a laminate, the plurality of wood layers preferably has interspersed therebetween a layer of adhesive 23 effective to adhere the plurality of wood layers together as is shown in FIG. 4. The adhesive 23 employed between the wood layers may be any waterproof adhesive capable of bonding to wood. Preferably, the adhesive is a plastic resin glue. An example of a commercially available plastic resin glue suitable for use in the present invention is Elmers wood glue, available from Knox Lumber Company.

Optionally, as also illustrated in FIG. 4, the wood layers may also have interspersed therebetween a layer of plywood backing paper 24. The addition of such a layer 24 would serve to add strength and rigidity. An example of commercially available plywood backing paper 24 suitable for use in the present invention includes Melamine®, available from Knox Lumber Company.

The wood layer itself may be formed of any type of wood desired. For example, woods suitable for use as the wood layer include, but are not limited to, oak, walnut, maple, teak, cherry, mahogany, pine or veneers thereof. Furthermore, rigid wood products, e.g., particle board, may also be used as the wood layer.

If two or more layers of wood are to be used in the wood layer, i.e., a laminate, it is preferred that at least one of the middle layers of wood be chosen from a wood that facilitates it being affixed to a support element. That is, in accordance with a preferred embodiment described below, it is desirable for wood chosen for use as a middle layer to be sufficiently soft so as to be capable of being stapled without breaking apart or cracking. Suitable types of wood for utilization in the middle layer include, but are not limited to, pine and mahogany.

Moreover, if the visor 12 is to comprise a wood laminate, it is not necessary that the plurality of wood layers be made from the same type of wood. For example, if desired, the upper, outer layer of wood 13 may be formed from one type of wood and the bottom, outer layer 15 may be formed from another type of wood. Nor is it necessary, if there are to be two or more internal wood layers, that the internal wood layers be formed from the same type of wood. Furthermore, although FIG. 4 depicts three layers of wood with a layer of plywood backing paper and adhesive separating each, the number of layers of wood is not a critical aspect of the invention. Rather, any number of layers may be used as long as the visor 12 is sufficiently rigid so as to maintain its shape over an extended period of time. Wood laminates are preferred, however, because the use of multiple layers of wood enhances the visor shape retaining capability.

Nor is the thickness of the individual layers of wood critical to the practice of the present invention. Additionally, it is not necessary that the layers of wood utilized be the same thickness. However, it is preferred that the overall thickness of the visor 12, i.e., the combined total of all the wood and glue layers, be from about 0.155 to 0.5 inches. More preferably, the overall thickness of the visor 12 will be from about 0.170 to about 0.35 inches thick. Most preferably, the layers of wood will be from about 0.181 to about 0.200 inches thick.

Figure 5:
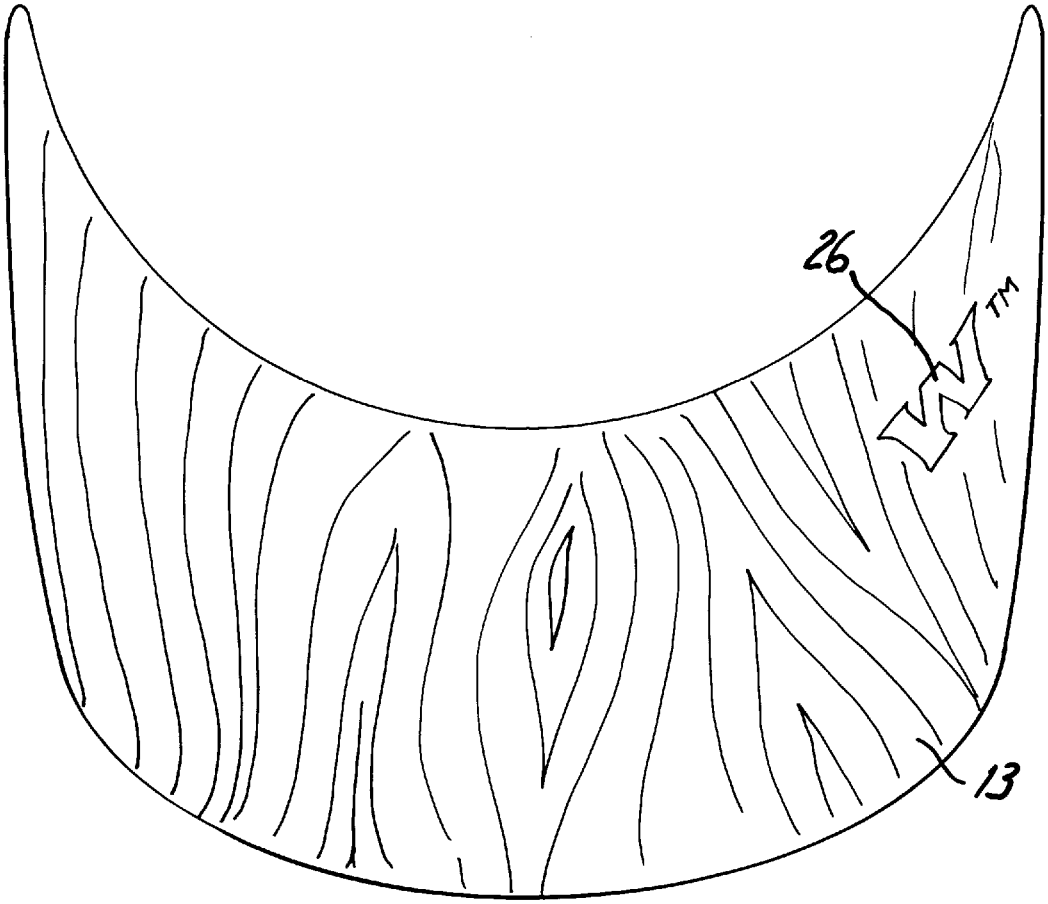
FIG. 5 is an overhead view of an upper surface of the visor of the present invention as it may appear when bearing a marking, such as a company symbol.
Figure 6:
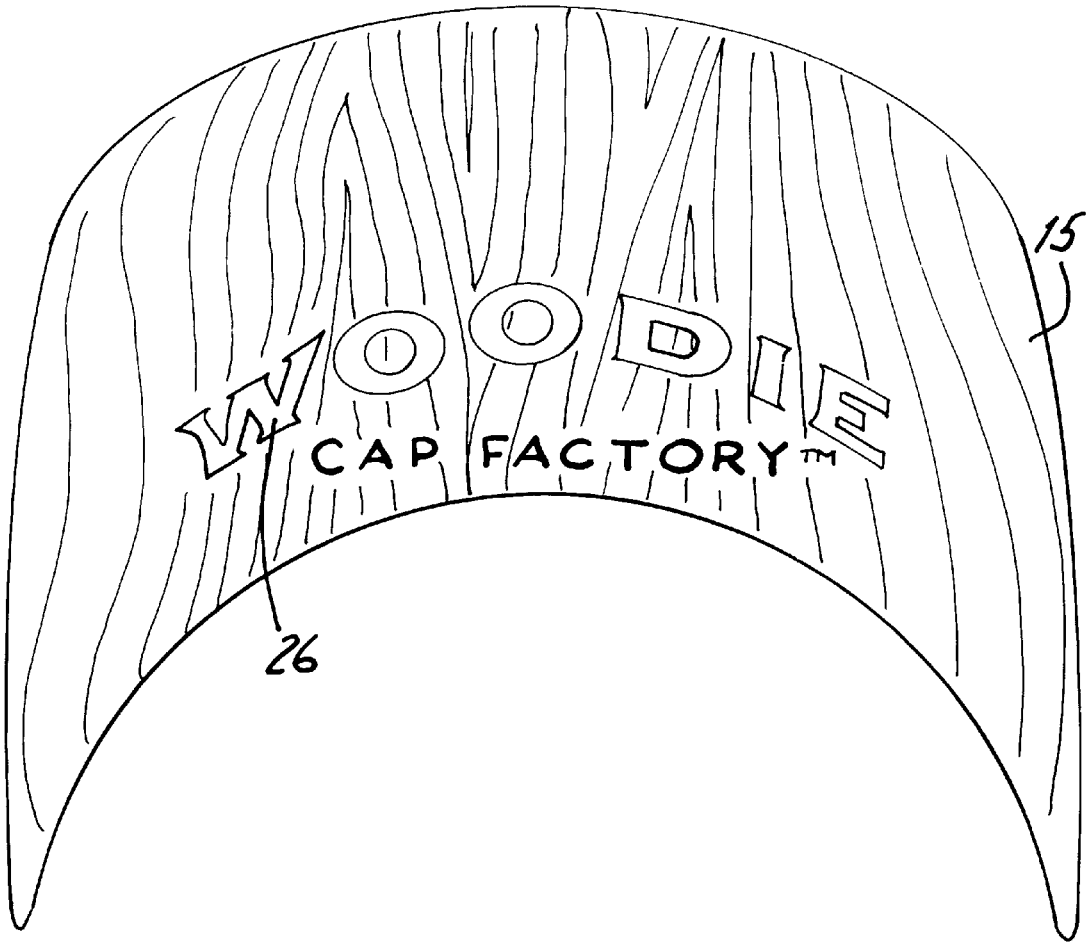
FIG. 6 is an overhead view of a lower surface of the visor of the present invention as it may appear when bearing a marking, such as a company symbol.

In addition to the advantage of providing an aesthetically pleasing wood grain appearance, the visor 12 of the present invention provides a durable wood surface upon which to fix designs. That is, as is illustrated in FIGS. 5 and 6, the surface of the visor 12 may also have a marking 26 such as a company symbol, insignia or trademark that is visible on either wood surface 13 or 15. Such a marking may be a decal, may be affixed by painting, may be burned, i.e., as a brand, carved, chiseled or cut into the wood surface.

Preferably, the visor 12 of the present invention is water-repellent, as well as water resistant. In order to provide the visor 12 with a water-resistant property, the visor 12 may be treated with a natural wax, such as paraffin. For example, once formed, the visor 12 may be dipped, sprayed or otherwise coated with paraffin which would absorb into the wood layer(s), thus rendering the visor 12 water resistant. Additionally, the visor 12 may be sprayed, painted or otherwise coated with a synthetic water-proofing agent, such as polyurethane. In a particularly preferred embodiment, the visor 12 is both treated with paraffin and coated with polyurethane.

In accordance with the preferred embodiment, the support element comprises a hat 10 connected to visor 12. The support element may, however, comprise any support element capable of at least partially encircling a human head. For example, the support element may be a flexible, plastic band that at least partially encircles a human head and remains in place through the application of pressure at several points along the band, a band capable of completely encircling a wearer's head, or a hat. A band may be flexible, stretchable or otherwise adjustable. For example, if the support element is a plastic band, the resulting visor 12 and support element combination would provide a visor 12 such as the type that are worn simply to shade the wearer's eyes rather than to also protect the top of the wearer's head from the sun.

The support element can be constructed in accordance with any known method and of any desirable material. Furthermore, the support element can be made in different sizes to fit different sized heads. The support element may also be made to be adjustable so that it will fit the head of any hat wearer, by utilizing any of the known adjustment means including elastic bands, band sizing adjustment straps or the like.

The visor 12 of the present invention may be constructed in accordance with any known method. For example, the visor 12 may be formed as follows. Multiple layers of wood are placed into a pre-determined curved mold with a layer of water-resistant glue between the wood layers. The layers are held in this curved mold until the glue has dried, about 24 hours. The curved, layered pieces are then removed from the mold and cut into visor shapes, such as by using a band saw or a computer generated cut. The individual visors are then preferably dipped into a penetrating water-proofing product, such as paraffin, and subsequently stained. A final water-proofing coat, e.g., a polyurethane, is then applied to the visor 12 surface.

If the visor 12 is to include a layer of plywood backing material, the visor 12 may be formed as follows. The lower, outer wood layer 15 and a layer of the plywood backing material 24 are laid on a form. Adhesive 23 is then added, and the middle, internal layer of wood 14 is added. Another layer of adhesive 23 is applied over the form, followed by another layer of plywood backing material 24, and the upper, outer layer of wood 13. The form is then closed until the adhesive dries, i.e., from about 5 hours to more than 24 hours. The visor shape is then cut out using a computer generated cut. If the visor 12 is to have a marking 26 affixed, it may be wood burned on the upper wood layer, so as to be visible, at this point. The front edge of the visor 12 is preferably then sanded and the entire visor 12 is dipped in a penetrating waterproofing product, such as paraffin. The visor 12 may then be stained, if desired and a final coat of waterproofing product may be applied, e.g., polyurethane.

Once the visor 12 has been constructed, it is attached to the support element. The means of attachment is not critical to the invention, that is, any method of attachment that is effective to hold the visor 12 in place is acceptable. For example, one suitable method of attaching the visor 12 to the support element, is to apply a line of adhesive to the inside edge of the visor 12, place the visor 12 in the desired position, and then staple the support element to the visor 12. Preferably, the staples will be inserted so as to enter one of the middle, internal wood layers. The staples may be applied by hand, or by using a pneumatic staple gun. If staples are to be used, they are preferably upholstery fasteners or staples. The staples may be made from any material, however, it is preferred that the staples be stainless steel, or more preferably, galvanized stainless steel to enhance the water resistance of the overall visor/support element combination. Furthermore, the staples may be of any size that is effective to affix the visor 12 to the support element. For example, standard upholstery staples are ¼" wide and ⅜" in depth.

As an alternative embodiment, the visor 12 of the present invention may be attached to the support element by means of an extension element of the visor construction. For example, when forming the visor 12 as indicated hereinabove, either a full or partial layer of a rigid material, such as plastic, may be provided and attached to a surface of the visor 12 or sandwiched within the laminant construction at any desired point. Preferably, the rigid layer would extend beyond the wood layers and be able to, or have a formed bend so as to provide a lip. The lip may then be attached to a support element in any conventional manner, such as by stitching or adhesive.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A visor for attachment to a support element for at least partially encircling a human head wherein said visor comprises a rigid wood layer.

2. The visor of claim 1 wherein said rigid wood layer defines a curved external surface to said visor.

3. The visor of claim 2 wherein said rigid wood layer provides a visible wood surface to said visor.

4. The visor of claim 3 wherein said rigid wood layer has a marking on said visible wood surface in addition to the natural wood grain.

5. The visor of claim 4 wherein said marking comprises a decal.

6. The visor of claim 4 wherein said marking comprises a brand recessed within the visible wood surface.

7. The visor of claim 4 wherein said marking is painted on said visible wood surface.

8. The visor of claim 3 wherein said rigid wood layer is coated with a layer of a waterproofing agent and said visible wood surface is seen through said waterproofing agent.

9. The visor of claim 8 wherein the waterproofing agent is a polyurethane.

10. The visor of claim 1 wherein said visor comprises a wood laminate.

11. The visor of claim 10 wherein said wood laminate comprises a plurality of wood layers.

12. The visor of claim 11 wherein at least two of said plurality of wood layers are separated by a layer of adhesive.

13. The visor of claim 11 wherein at least two of said plurality of wood layers are separated by a layer of adhesive and a layer of plywood backing paper.

14. The visor of claim 1 wherein said rigid wood layer is selected from the group consisting of oak, walnut, maple, teak, cherry, mahogany, pine, veneers, and combinations thereof.

15. A visor for attachment to a support element for at least partially encircling a human head, wherein said visor comprises a visible surface with a wood grain appearance.

16. The visor of claim 15 wherein the wood grain appearance is provided by an external layer of decorative material exhibiting a wood grain design and which is bonded to said visor.

17. A visor in combination with a support element for at least partially encircling a human head so that the visor can be supported on a wearer's head and wherein said visor is connected to said support element and comprises a rigid wood layer.

18. The combination of claim 17 wherein said rigid wood layer provides an visible wood surface to said visor.

19. The combination of claim 18 wherein said rigid wood layer has a marking on said visible wood surface in addition to the natural wood grain.

20. The combination of claim 19 wherein said marking comprises a decal.

21. The combination of claim 19 wherein said marking comprises a brand recessed within the visible wood surface.

22. The combination of claim 19 wherein said marking is painted on said visible wood surface.

23. The combination of claim 18 wherein said rigid wood layer is coated with a layer of a waterproofing agent and said visible wood layer is seen through said waterproofing agent.

24. The combination of claim 23 wherein the waterproofing agent is a polyurethane.

25. The combination of claim 17 wherein said visor comprises a wood laminate.

26. The combination of claim 25 wherein said wood laminate comprises a plurality of wood layers.

27. The combination of claim 26 wherein at least two of said plurality of wood layers are separated by a layer of adhesive.

28. The combination of claim 26 wherein at least two of said plurality of wood layers are separated by a layer of adhesive and a layer of plywood backing paper.

29. The combination of claim 25 wherein said rigid wood layer is selected from the group consisting of oak, walnut, maple, teak, cherry, mahogany, pine, veneers, and combinations thereof.

30. The combination of claim 17 wherein said support element comprises a band capable of completely encircling a wearer's head.

31. The combination of claim 17 wherein said support element comprises a hat.

32. The combination of claim 31 wherein said visor and support element together provide a baseball hat.

33. The combination of claim 17 wherein said rigid wood layer is attached to said support element by at least one staple.

34. The combination of claim 33 wherein the staple is an upholstery staple.

35. The combination of claim 17 wherein said rigid wood layer is attached to said support element by at least one rivet.

36. The combination of claim 17 wherein said rigid wood layer is attached to said support element by adhesive.

37. The combination of claim 17 wherein said rigid wood layer is attached to said support element by a combination of at least one upholstery staple and adhesive.

38. A visor in combination with a support element for at least partially encircling a human head so that the visor can be supported on a wearer's head and wherein said visor is connected to said support element and comprises a visible surface with a wood grain appearance.

39. The visor of claim 38 wherein the wood grain appearance is provided by an exterior layer of decorative material exhibiting a wood grain design and which is bonded to said visor.

40. A baseball cap comprising:

a visor comprising a wood laminate wherein said laminate includes plural wood layers including a first layer for providing a visible wood grain surface and at least one layer of which comprises mahogany;

a baseball cap; and wherein said baseball cap is connected to said visor by an upholstery staple including plural prongs that are provided through a lower band portion of cap material and which extend into said mahogany layer.

* * * * *